United States Patent [19]
Melvin
[11] 4,319,555
[45] Mar. 16, 1982

[54] DUAL GRATE FOR BURNING WOOD AND COAL

[76] Inventor: Morton A. Melvin, R.F.D. 1, Box 38D, Jay, Me. 04239

[21] Appl. No.: 209,918

[22] Filed: Nov. 24, 1980

[51] Int. Cl.[3] ..... F24C 1/00; F23H 7/08

[52] U.S. Cl. ..... 126/60; 126/152 B; 126/158; 126/162; 126/177

[58] Field of Search ..... 126/60, 65, 64, 152 R, 126/152 A, 152 B, 163 R, 162, 77, 83, 171, 177, 174, 181, 167, 173, 158, 155, 176 A, 176 R, 168, 151, 147; 110/298, 281, 289

[56] References Cited

U.S. PATENT DOCUMENTS

| | | | |
|---|---|---|---|
| 501,623 | 0/1893 | Long . | |
| 828,476 | 8/1906 | Heister | 126/174 |
| 830,705 | 9/1906 | Ferguson | 126/177 |
| 949,065 | 2/1910 | Fowler | 126/177 |
| 1,205,616 | 11/1916 | Gilbert et al. | 126/176 R |
| 1,207,751 | 0/1916 | Hansell . | |
| 1,906,227 | 5/1933 | Hulson | 126/177 |
| 2,790,401 | 4/1957 | Hebert | 126/162 |
| 4,240,362 | 12/1980 | Wigdahl | 126/151 |
| 4,258,692 | 3/1981 | Mackey | 126/176 R |

FOREIGN PATENT DOCUMENTS 102377 4/1899 Fed. Rep. of Germany .

*Primary Examiner*—James C. Yeung
*Attorney, Agent, or Firm*—Dowell & Dowell

[57] ABSTRACT

A solid fuel burner having a housing with runners mounted inside its sidewalls and vertical rods passing upwardly through the runners which support two frames each having a shaker-grid opening therethrough with a shaker grid rockably supported therein, the shaker grids being capable of separate shaking so that one grid can support a coal fire and the other support a wood fire, and the frames having air slots therethrough offset from the grid openings with plugs for selectively closing them, and sideliner plates restable on the frames and leaning outwardly against the vertical rods between the grids and the sidewalls.

10 Claims, 7 Drawing Figures

FIG. 5.
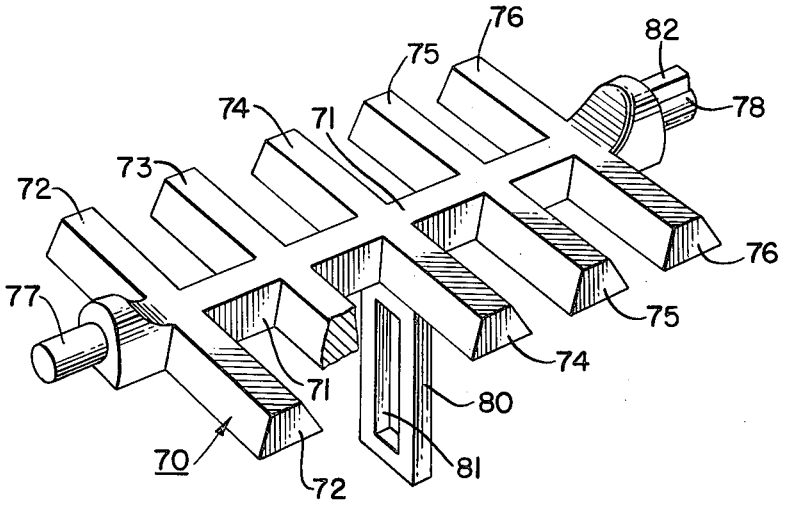
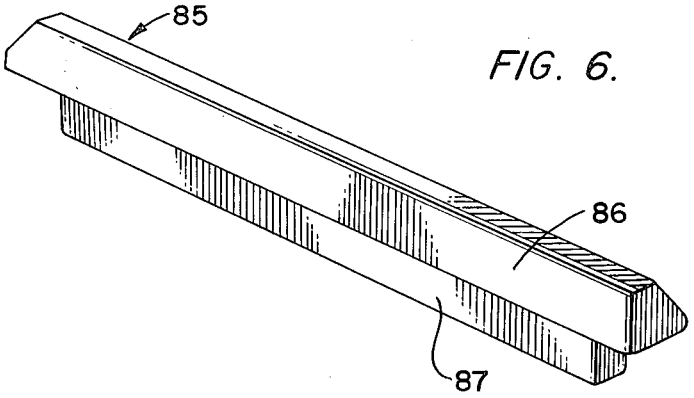
FIG. 6.
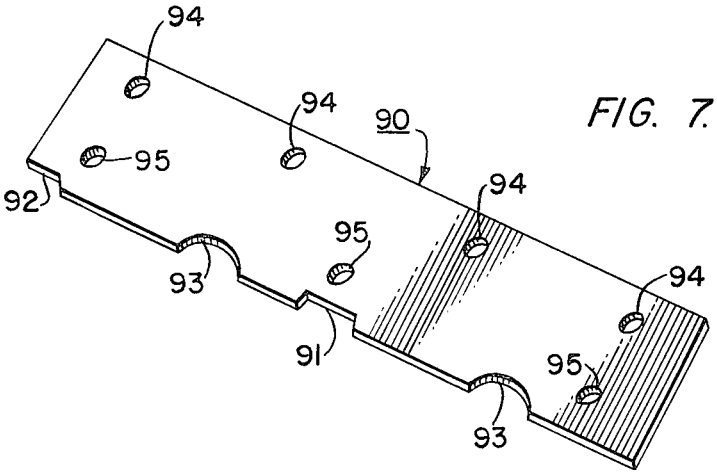
FIG. 7.

DUAL GRATE FOR BURNING WOOD AND COAL

BACKGROUND AND PRIOR ART

The high cost and uncertain availability of oil as a fuel has resulted in the increased use of solid fuels, and particularly the burning of wood in various heaters such as stoves, space heaters and boiler units, the burning of wood being particularly attractive in areas which are heavily forested. However, even in cases where wood is inexpensive and easily available, wood is not a complete answer to the problems of heating a home. One major drawback in woodburning systems is the fact that wood burns relatively quickly, and it is therefore not practical to bank a wood fire so that it remains hot overnight, or during the daytime when the occupants are away at work. Under these circumstances coal burns a much longer time. It is therefore apparent that it is highly desirable to provide a heater which is able to burn wood or coal interchangeably so that wood can be used as a cheap fuel curing hours when the premises are occupied, and coal can be used either partly or entirely when the fire is to be banked for longer unattended intervals.

However, the burning characteristics of wood and coal are somewhat different. For instance, coal needs about 80% of the air fed to it from beneath the fire with only about 20% of the air fed from above to burn off escaping volatile gases. Conversely, wood requires about half of the air coming from below and about half of the air supplied above the fire to burn efficiently. The difference in air flow can be controlled primarily by the ash which remains on the grate beneath the burning wood or coal. Since coal requires most of the air coming from below, efficient burning of the coal requires periodic shaking of the grate in order to pass the burned ash into the ashpit and facilitate the flow of air to the bottom of the burning coal fire. On the other hand, when burning wood it is desirable not to shake the grate system so that wood ash tends to remain in the grate beneath the wood and restrict the flow of air upwardly through the grate so that a higher percentage of the air, than would be the case in a coal fire, is fed to the fire above the burning wood. Of course, when a coal fire is to be banked for a long period of time, it becomes undesirable to shake the ash since it is not desirable to burn the coal at a high rate when a long lasting fire is then needed. Moreover, it may occasionally become desirable to dump the fire into the ashpit for the purpose of quickly reducing an overheat condition, and therefore the shaker grid on which the fire rests should be movable to a full dumping position so that the coals can fall into the ashpit unimpeded. Since it is often desirable to burn both coal and wood at the same time, a dual grate system is provided herein so that the coal supporting portion of the system can be shaken down without disturbing the bed of ashes beneath the woodburning portion of the system, or so that the coal-burning portion can be dumped into the ashpit if desired.

German Pat. No. 102,377, which was issued Apr. 6, 1898, shows a dual grate and shaker system in which separate shaker members are supported in two different shaker frames, one behind the other, the shakers having downwardly extending arms which can be used to rock the shaker back and forth. However, this system is not capable of fully dumping the coals in the case of an overheat since the stationary portion of the shaker frame has stationary fingers which interleave with the fingers of the movable shaker grid. U.S. Pat. Nos. 501,623 to Long and 1,207,751 to Hansell show other grate assemblies having two different groups of shakers which can be separately actuated to shakedown the fires in different locations.

THE INVENTION

The invention comprises a wood or coal burning dual grate system including two separate shaker-grid frames which are supported one behind the other inside of a heater housing on runners which are welded to the wall of the housing and further supported by vertical rods extending to the floor of the housing. The angle runners have notches which locate the separate shaker frames, one behind the other, inside the heater housing, each shaker frame being an open rectangular frame without fingers for supporting the fire. The frames also each have spaced bearings for supporting a shaker grid inside of each open frame, each shaker grid having a plurality of fingers extending both ways from a central member, and extending almost into contact with the frame in which the shaker grid is supported. Each shaker grid also has a downwardly extending yoke which extends beneath the grate assembly and can be contacted by a poker for rocking the grid through short strokes back and forth of the poker. The frames also carry upstanding tabs which are used to support vertical sideliner plates along the edges of the grates, which sideliners lean against the vertical rods and are spaced by a small distance from the sidewalls of the heater housing to protect the housing and the supporting runners from overheating and damage. Each of the grate frames has an airslot which is offset from the opening in which the shaker grid is supported, and each slot can be selectively closed by an air adjustment plug which fits into the slot, thereby slowing the rate of air passage therethrough to control the combustion in moderate weather or when the fire is to be banked for a long period of time. The grate frames overlap each other and are supported on sidelugs and bars which extend transversely across beneath the frames and between the runners which are welded onto the sidewalls, so that all parts of the assembly including the frames, the supporting bars, the shaker grids, the air plugs, and the sideliners can be immediately and easily removed for servicing or replacement, leaving in the heater housing only the vertical rods and runners which form part of the housing.

OBJECT AND ADVANTAGES

It is a principle object of the invention to provide a dual solid fuel shaker grate assembly for mounting inside the housing of a heater so that wood and coal can be burned selectively in adjacent grate portions of the assembly, or so that the same fuel can be burned in both portions in an efficient and flexible way, the dual portions being individually provided with separate shaker grids on which the fires are supported so that the two portions can be separately shaken, i.e. so that a coal fire can be shaken without disturbing the ash under an adjacent wood fire, and so that where the same fuel is used in both portions, the shaker grid which supports the more rapidly burning fire can be shaken more often, one portion usually burning at a different rate than the other portion due to differences in drafts within the housing.

It is another important object of the invention to provide air plugs which can be inserted to close slots through the shaker frames so as to reduce the rate of air flow upwardly through the frames adjacent to the burning fuel in order to control the rate of combustion in mild weather or for the purpose of permitting a better banking of a fire when it must be left unattended for long intervals.

It is another important object of the invention to provide a dual grate assembly having sideliner plates which fit into place along the sides of the grate frames and lean outwardly toward the sidewalls of the heater housing without coming into contact therewith, so as to allow a small space between the sideliner plates and the heater housing to permit air to flow upwardly between the sideliners and the sidewalls, the liner plates being provided with a pattern of airholes allowing a controlled amount of air to be introduced just above the glowing coals for the purpose of burning off volatile gases given off by the fuel during combustion. These sideliner plates not only protect the sidewalls of the heater housing, and the mountings of the grates, but also tend to channel the heat of the fire upwardly toward the top of the space heater or toward a boiler located just above the fire.

It is a further object of the invention to place the dual shakers parallel to each other but one behind the other with respect to the fuel loading door in the front of the housing so that wood can be burned in the front portion of the grate assembly where it is easily attended for the purpose of inserting new logs, while the longer burning coal in the rear requires less attention and is generally easier to replenish with new coal when it has burned down, since the coal can be easily inserted toward the rear of the burner using a shovel. Logs are generally more difficult and awkward to handle.

It is still another object of the invention to provide a system of runners having slots to cooperate with side lugs on the grate frames so that they are easily changed, while the side lugs accurately locate the grate frames in place. The frames must be prevented from shifting longitudinally along the supporting runners, since rocking of the shaker grids using a poker will apply forces which tend to displace the frames back and forth on the runners.

Still another object of the invention is to provide an assembly of grate frames and shaker grids wherein all of the coal supporting fingers are carried on the movable shakers, and wherein the frames are free of fingers so that if the shakers are rotated to a position in which the fingers are substantially vertical, the coal can be quickly and easily dumped into the ashpit in the event of an overheat situation occurring. The rocker yokes are located substantially in the center of each of the shaker grids so that the rocking forces applied when a poker is inserted in the yoke and reciprocated will not provide undesirable slewing forces to the shaker grid tending to dislodge its pintles from the supporting grate frames due to unequal leverage.

Other objects and advantages of the invention will become apparent during the following discussion of the drawings.

THE DRAWINGS

FIG. 5 is a perspective view of a shaker grid;

FIG. 6 is a perspective view of an air control plug insertable in a slot of a shaker frame; and FIG. 7 is a perspective view of a sideliner plate according to the present invention.

DESCRIPTION OF PREFERRED EMBODIMENT

Figure 1:
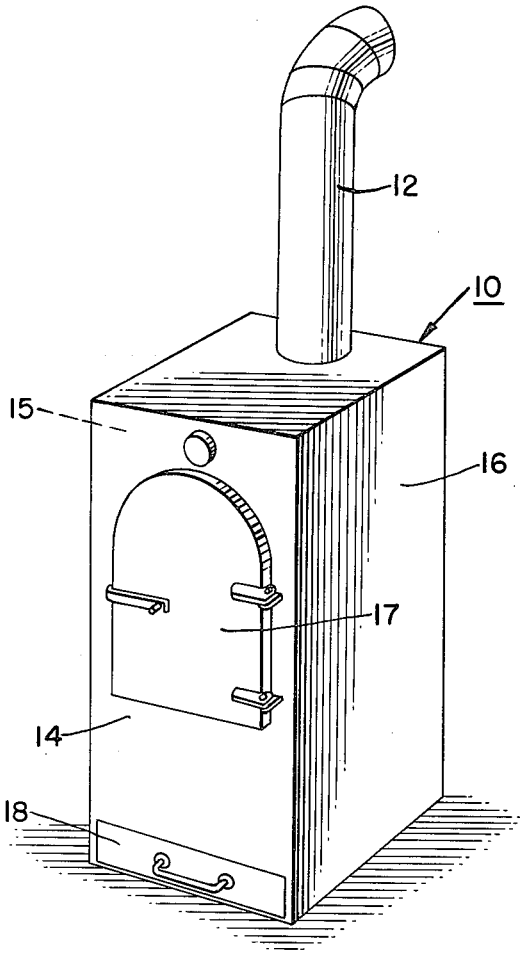
FIG. 1 is a perspective view showing a heater housing according to the present invention.
Figure 2:
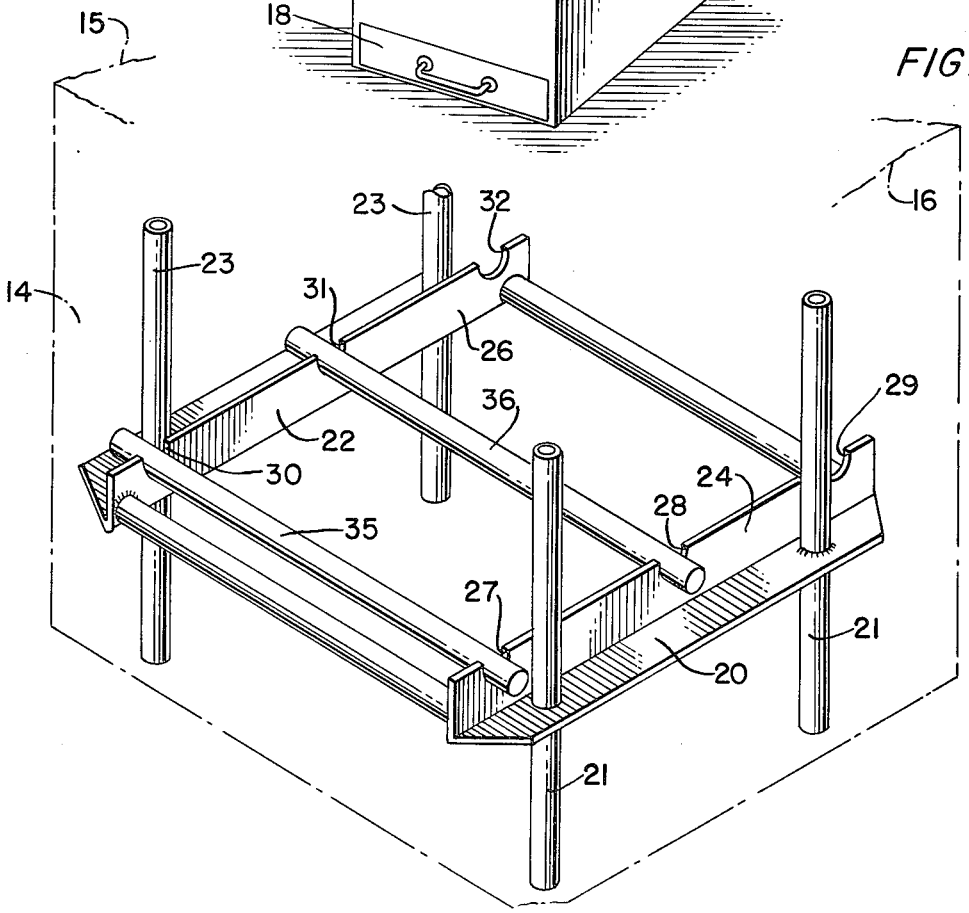
FIG. 2 is an enlarged perspective view showing vertical rods and horizontal runners which support grate assemblies within the heater housing, the walls of the housing being shown in dash-dot lines.

Referring now to the drawings, FIG. 1 shows a housing 10 comprising, for example a space heater or a boiler, which is heated by burning one or more solid fuels. The housing has the products of combustion carried off by a pipe 12, and is provided with a front wall 14, sidewalls 15 and 16. The housing has an upper door 17 which can be opened to attend the fire by putting additional fuel thereon, and further includes a lower door 18 which can be opened to gain access to an ashpit inside of the housing. In FIG. 2, these various walls are shown in dash-dot lines so as to reveal the grate support structure of the heater housing.

Figure 3:
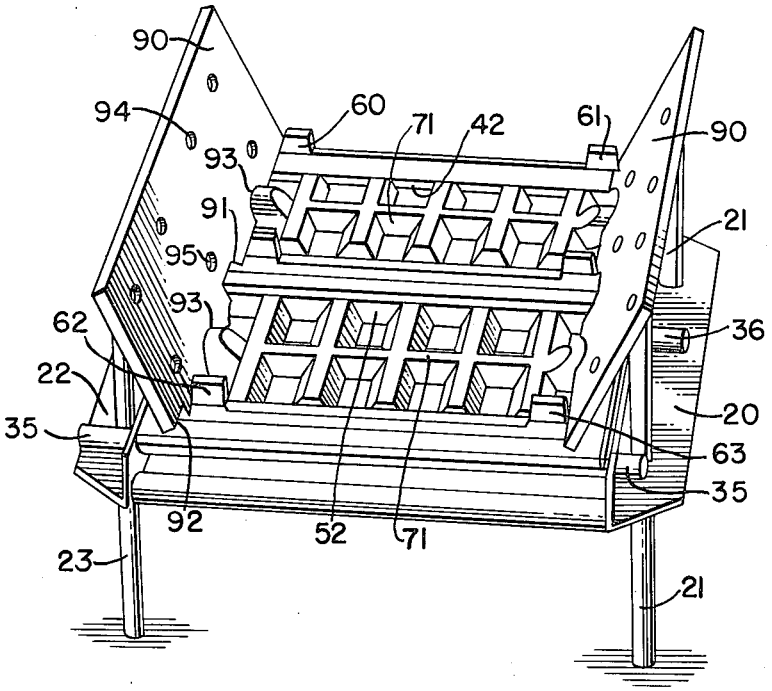
FIG. 3 is a perspective view showing the runners and vertical rods supporting a system of grate frames and shaker grids and sideliner plates, the heater housing walls being omitted from this view.

Within the heater housing there are two runners 20 and 22 fixed to opposite sidewalls 16 and 15 respectively. These runners comprise angle bars which are welded to the sidewalls 16 and 15 respectively, and the structure further includes vertical rods 21 and 23 which rest upon the floor of the housing and are welded where they pass through the angle bars 20 and 22 respectively. The rods extend somewhat above the angle bars for the purpose to be hereinafter stated. Each of the angle bar runners 20 and 22 has a vertical portion 24 and 26 provided with three grooves, the grooves in the portion 24 being labelled 27, 28 and 29, and the grooves in the portion 26 being labelled 30, 31 and 32. A metal bar 35 rests in the grooves 27 and 30, and another similar metal bar 36 rests in the grooves 28 and 31 for the purpose hereinafter stated. As shown in FIG. 2 the grooves 29 and 32 remain empty. The assembly shown in solid lines in FIG. 2 supports the front and rear frames which are shown in FIGS. 3 and 4.

Figure 4:
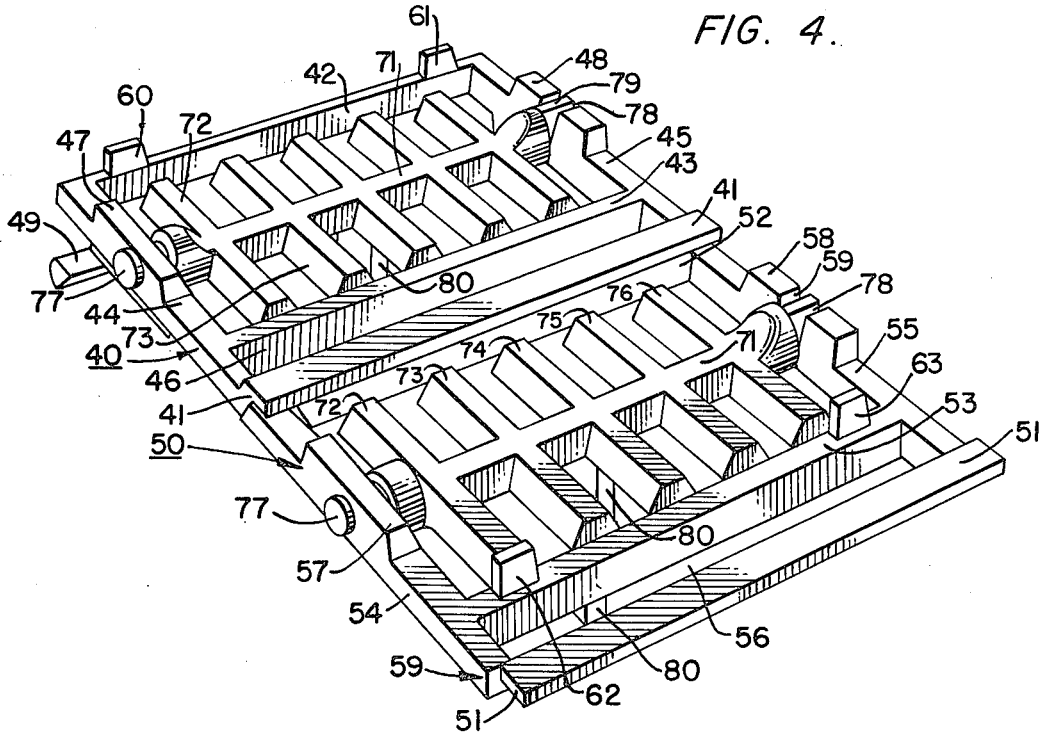
FIG. 4 is a perspective view showing two grate frames overlapping each other and showing shaker grids mounted in the frames.

The front and rear frames in FIG. 4 are generally referred to by the reference characters 50 and 40, and are similar but not identical. The rear frame 40 has two oppositely extending side lugs 49 which extend transversely therefrom and rest respectively in the grooves 29 and 32 of the runners 20 and 22 to support and locate the rear portion of the rear frame 40. The front portion of the rear frame 40 in the vicinity of the reference character 41 has a raised lip similar to the lip 51 on the front frame member, and the lip 41 rests on top of the rear edge 52 of the front frame 50. The rear edge 52 in turn rests upon the rod 36 shown in FIG. 2, which rod supports both the rear of the frame 50 and the front of the frame 40. Likewise, the front of the frame 50 rests upon the rod 35 in the vicinity of the reference character 59 at the bottom of FIG. 4. Each of the frames has a rectangular grid-supporting opening bounded respectively by the rear members 42 and 52, by a front member 43 and 53, and by opposed side members 44 and 45 on the frame 40, and 54 and 55 on the frame 50, these members defining two rectangular openings through the frames covering most of the area of the frame. The members 41 and 43 as well as the members 51 and 53 define between them an air slot labelled 46 in the frame 40 and 56 in the frame 50. These slots serve a purpose to be hereinafter described in greater detail. Each of the left side members of the frames 44 and 54 has a raised boss 47 and 57, respectively, and each of these bosses has a bearing hole through it for receiving the pintle of a shaker grid which will be described hereinbelow. On the other side members 45 and 55 of the grid frames there is another raised boss 48 and 58 having a bearing groove 79 and 59 receiving the other pintle of the shaker grid as will be presently described.

The rear frame 40 supports on its rear member 42 a pair of tabs 60 and 61 which correspond in lateral location with tabs 62 and 63 on the member 53 of the front frame 50, which tabs serve to support sideliner plates which will be described hereinafter.

The shaker grids 70 are identical to each other in the illustrated embodiment and are therefore given the same reference numerals. These grids are referred to generally by the numeral 70 and can be seen best in FIG. 5. Each shaker grid comprises an elongated central bar 71 with a plurality of fingers 72, 73, 74, 75 and 76 extending outwardly at right angles from the bar 71. These fingers are slightly shorter than the spacing between the frame members 42 and 43 and between the frame members 52 and 53 as shown in FIG. 4. At each end of the central bar 71 is located a boss which supports a pintle, the lefthand pintle being labelled 77 and the righthand pintle being labelled 78. The pintle 77 extends through a bearing hole in a boss 47 or 57, while the righthand pintle 78 extends through a groove 59 or 79, serving as a bearing to support the righthand end of the shaker grid which then occupies the opening in one of the grate frames 40 or 50. It will be noted that the fingers are in the shape of truncated pyramids and are placed close together so that they can support ash beneath burning coals. Each of the shaker grids also has a downwardly extending yoke 80 with a slot 81, FIG. 5, extending through it so that a poker can be passed into the heater housing through the ashpit door 18 and hooked into one of the yokes so as to rock the shaker grid angularly about its pintles 77 and 78. Each of the pintles 78 has a rectangular extension 82 fixed thereon for the purpose of normally limiting the angle through which the shaker grid will tilt during small increments of reciprocation of the poker for the purpose of shaking the ash beneath a coal fire without permitting larger burning coals to pass through the grate. However, if the poker is pulled hard, the pintle 78 will ride up in the groove 59 or 79 and permit the shaker grid to be tilted so that the fingers 72 through 76 are essentially vertical, thereby dumping the entire fire into the ashpit, which may be highly desirable during overheat circumstances.

FIG. 6 shows an air plug 85 having an enlarged upper portion 86 and having a smaller tongue portion 87 which can be fitted into either the slot 46 or 56 as can best be seen in FIG. 4 for the sake of selectively closing these slots, or either of them, in order to restrict the flow of air upwardly through the slots thereby causing the rate of combustion to be slowed. These plugs are especially useful in mild weather or when a fire is to be left unattended for some time, so as to cause it to burn more slowly. The plugs are the same length as the slot and their tongue portions 87 are about as wide as the slot, whereby the slot is substantially filled and closed by the plug.

FIG. 7 shows a sideliner plate 90, two of which are used as shown in FIG. 3. The sideliner plate has its lower edge cut out at 91 to receive the raised bar member 41 of the rear grate frame. In addition, the plate has a cutout at 92 to receive the front raised member 51 of the front grate frame 50. The two cutouts 93 serve to provide clearance for the bosses at the end of the shaker grid bar 71 from which the pintle members 77 and 78 respectively extend, as can be seen best in FIG. 3. In addition, as can be seen in FIGS. 3 and 7 the plates have two rows of air holes which are respectively labelled 94 in the top row and 95 in the bottom row, these holes serving to allow a limited flow of air to pass through the plate into the vicinity of the hot coals and immediately above them for the purpose of burning off gases that are driven from the coals. The word coals as used herein refers to the glowing coals either of a wood or of a coal fire. The sideliner plates 90 lean outwardly against the vertical rods 21 and 22 and have their bottom ends confined by the tabs 60, 61, 62 and 63 respectively, and serve to shield the sidewalls of the housing, and the runners and rods and pintles from the heat of the fire while controlling the rate of flow of air thereto.

All of the members in the present disclosure as shown in FIGS. 2 through 7 are either cast iron or steel plate or rods.

This invention is not to be limited to the exact embodiments shown in the drawings, for obviously changes can be made therein within the scope of the following claims. For instance, if it were determined that one of the two grate portions was to burn wood only and not coal, the rocking shaker grid in that one section could be replaced by a stationary grid.

I claim:

1. In a heater for burning solid fuels, the heater having a housing with enclosing side and rear walls and a front wall having upper and lower doors; an improved grate structure and mounting therefore, comprising:

(a) a pair of opposed horizontal runners fixed to said sidewalls at a level between said doors and having rods extending vertically through the runners parallel to the sidewalls, the runners having multiple pairs of grooves in their upper surfaces, each groove being aligned with a similar groove in the opposite runner;

(b) grate frames supported horizontally between the runners, and having lugs supported in and located by said grooves, each grate frame having a shaker-grid opening therein and having opposed bearing holes located adjacent to said runners;

(c) a shaker grid in each frame, each shaker grid having oppositely extending pintles resting in the bearing holes of a frame, and having ash supporting fingers extending horizontally at right angles to said pintles toward the frame, and each grid having a shaker yoke extending at right angles to the fingers for rocking the grid about said pintles; and (d) a pair of sideliner plates, each extending substantially the length of a runner, the plates being supported on the frames and leaning against the rods and diverging upwardly toward the sidewalls.

2. The heater as claimed in claim 1, wherein the grate frames have upstanding tabs on each side located near the runners, the sideliner plates resting on the frames between the tabs and the runners and leaning against the vertical rods which space the plates from the sidewalls.

3. The heater as claimed in claim 1, wherein the sideliner plates are notched to pass the pintles therethrough and are provided with a pattern of air holes to pass a controlled flow of air to a level above the shaker grids.

4. The heater as claimed in claim 1, wherein the sideliner plate are disposed between the shaker grids on one side and the runners and vertical rods and pintles and sidewalls on the other side to protect the latter from heat.

5. The heater as claimed in claim 1, wherein the shaker-grid openings through the frames are rectangular in shape and the ash supporting fingers are all supported on the shaker grids, the fingers extending toward the frame with small clearances therebetween, and the pintles being shaped to retain the fingers of the grid normally horizontal.

6. The heater as claimed in claim 1, wherein the runners support multiple grate frames, all with their bearing holes disposed parallel with the front wall of the housing, and the shaker grid yokes in the frames extending downwardly to the level of the lower door through which they are separately accessible for shaking down the ash from the fingers.

7. The heater as claimed in claim 6, wherein support rods are laid into pairs of the runner grooves so that they extend between the runners, and said multiple grate frames rest on said support bars, the grate frames lapping each other where they intersect.

8. The heater as claimed in claim 7, wherein the grate frame furthest from the upper door has outstanding lugs engaging one pair of the grooves and locating the frame with respect to the runners.

9. The heater as claimed in claim 1, wherein the grate frames have air slots therethrough for passing air from below the grate to the space above the grate along paths offset from and extending around the shaker grids.

10. The heater as claimed in claim 9, further including plug means shaped to fit into the air slots and close them to control the burning rate by reducing the air flow.

* * * * *